US012065850B2

(12) United States Patent
Heineman

(10) Patent No.: US 12,065,850 B2
(45) Date of Patent: Aug. 20, 2024

(54) OUTDOOR BLANKET AND VEHICLE PRIVACY CURTAIN

(71) Applicant: Car Cabana LLC, Anoka, MN (US)

(72) Inventor: Sarah Elizabeth Heineman, Anoka, MN (US)

(73) Assignee: Car Cabana LLC, Anoka, MN (US)

( * ) Notice: Subject to any disclaimer, the term of this patent is extended or adjusted under 35 U.S.C. 154(b) by 161 days.

(21) Appl. No.: 17/939,862

(22) Filed: Sep. 7, 2022

(65) Prior Publication Data

US 2024/0076896 A1 Mar. 7, 2024

Related U.S. Application Data

(60) Provisional application No. 63/305,117, filed on Jan. 31, 2022.

(51) Int. Cl.
*E04H 15/06* (2006.01)
*E04H 15/08* (2006.01)
*E04H 15/64* (2006.01)

(52) U.S. Cl.
CPC ..... *E04H 15/06* (2013.01); *E04H 15/08* (2013.01); *E04H 15/64* (2013.01); *A47H 2201/01* (2013.01); *Y10S 135/902* (2013.01)

(58) Field of Classification Search
CPC ..... E04H 15/06; E04H 15/08; E04H 15/64; E04H 1/1244; A47H 2201/01; Y10S 135/902
USPC ..... 135/88.07, 88.09, 88.14–88.17
See application file for complete search history.

(56) References Cited

U.S. PATENT DOCUMENTS

| | | | | |
|---|---|---|---|---|
| 4,544,195 | A * | 10/1985 | Gunn | B60P 3/341 160/DIG. 18 |
| 9,834,951 | B1 * | 12/2017 | Townley | E04H 15/08 |
| 9,994,089 | B1 * | 6/2018 | Salter | B60Q 1/2661 |
| 10,765,108 | B2 | 9/2020 | Seaton et al. | |
| 2006/0049652 | A1 * | 3/2006 | Martin | E04H 15/06 296/26.08 |
| 2013/0112355 | A1 * | 5/2013 | Roth | A47H 23/00 160/127 |
| 2019/0128057 | A1 * | 5/2019 | Futch | E04H 15/08 |
| 2023/0034523 | A1 * | 2/2023 | Bailey | E04H 15/06 |

* cited by examiner

*Primary Examiner* — Robert Canfield
(74) *Attorney, Agent, or Firm* — Christensen, Fonder, Dardi & Herbert PLLC.; Douglas J. Christensen

(57) ABSTRACT

Embodiments are directed to a vehicle privacy curtain attachable to a vehicle to form a private enclosed area. The curtain can include a piece of flexible material including a main portion positioned between a laterally extending first flap, a laterally extending second flap, and a vertically extending third flap. In various embodiments the curtain further includes a first set of magnets in the first flap and a second set of magnets in the second flap each including one or more magnets positioned inwardly from a lateral edge at a distance of 0% to 33% of a lateral width of the respective first flap. In embodiments the curtain includes a third set of magnets in the third flap including third and fourth magnets positioned inwardly from their respective edges at a distance of 0% to 33% of a lateral width of the third flap.

16 Claims, 6 Drawing Sheets

OUTDOOR BLANKET AND VEHICLE PRIVACY CURTAIN

RELATED APPLICATIONS

The present application claims the benefit of U.S. Provisional application 63/305,117 filed Jan. 31, 2022 and is incorporated by reference herein.

FIELD OF THE DISCLOSURE

The present disclosure relates to temporary changing room, and more specifically, to a vehicle privacy curtain for attaching to a vehicle.

BACKGROUND

When parents bring their children to the beach or the pool, oftentimes there may not be changing room facilities available or if there are facilities available such facilities may not be adequate for them to use. Further, in some instances the parent may be outnumbered, or their children may be of a certain age, both scenarios which make the use of public changing room facilities more difficult.

Thus, to avoid the use of a public changing room parents will often choose to instead change their children inside their vehicle. However, the interior of a car isn't well suited for changing children, often having very little space available and requiring a parent to putt wet or sandy children in the car after the day at the beach. Further, existing temporary changing room products are generally made for one person meaning that it's hard for a parent to change their child in the space. In addition, parents are already bringing many things to the beach, it's hard to justify another single use product. Clearly, further improvements to the field of temporary changing rooms would be well received.

SUMMARY

Various embodiments of the disclosure are directed to a vehicle privacy curtain including a piece of flexible material and a plurality of vehicle attachment devices configured to attach the curtain to the hatchback door of a vehicle to form an at least partially enclosed area between the curtain and the vehicle when the hatchback door is in an open configuration.

As stated above, when parents bring their children to the pool or the beach, oftentimes there are not adequate changing room facilities for them to use. Embodiments of the disclosure address this problem by providing a device that allows a parent to create a personal changing room easily and quickly behind their minivan or SUV by draping their unit over their hatchback so they don't have to rely on public changing rooms and can privately change their children into dry clothes before getting into their vehicle.

Further, embodiments of the disclosure improve upon existing temporary changing room designs by providing a simple setup process that does not require any other attachment mechanisms besides a few magnets. This allows parents a temporary personal changing room that sets up and tears down in just seconds. Still further, various embodiments improve upon existing designs by connecting to the exterior hatchback door of a vehicle and to the exterior sidewalls of the vehicle to create an enclosed space that can accommodate multiple people, such as a parent and one or more children within.

In addition, various embodiments provide multiple uses besides as a privacy curtain. For example, in various embodiments are suitable for use as a large, family-sized beach blanket. For example, various embodiments include a plurality of attachment loops and/or pockets that allow the device to be weighted down for use as an outdoor blanket.

As such, in various embodiments the vehicle privacy curtain includes a piece of flexible material having a front side and a rear side and having a lateral width and a vertical height. In one or more embodiments the piece of flexible material includes a main portion positioned between a laterally extending first flap, a laterally extending second flap, and a vertically extending third flap. In various embodiments the first flap defines a vertically extending first edge and a laterally extending first top edge, the second flap defines a vertically extending second edge and a laterally extending second top edge. In one or more embodiments the first flap, the second flap, and the main portion together form a bottom edge that defines the lateral width of the piece of flexible material.

In various embodiments the third flap defines a pair of vertically extending edges and a third laterally extending top edge that extends partially along the lateral width of the piece of flexible material. In one or more embodiments the pair of vertically extending edges intersect with the first and second top edge and the third top edge is a top-most edge of the piece of flexible material. In various embodiments the first and second top edge, the pair of vertically extending edges, and the third top edge together form a top edge of the piece of flexible material and the third flap and the main portion together define the vertical height of the piece of flexible material.

In various embodiments the curtain further includes a first set of magnets in the first flap, the first set of magnets including at least a first magnet positioned inwardly from the first edge at a distance of 0% to 33% of a lateral width of the first flap. In various embodiments the curtain further includes a second set of magnets in the second flap, the second set of magnets including at least a second magnet positioned inwardly from the second edge at a distance of 0% to 33% of a lateral width of the second flap. In one or more embodiments the curtain further includes a third set of magnets in the third flap, the third set of magnets including at least a third magnet positioned inwardly from one of the pair of vertically extending edges and a fourth magnet positioned inwardly from the other of the pair of vertically extending edges, the third and fourth magnets positioned inwardly from their respective edges at a distance of 0% to 33% of a lateral width of the third flap. In one or more embodiments the curtain further includes a plurality of pockets configured to receive material to weight the privacy curtain. In one or more embodiments the plurality of pockets are formed on the rear side of the flexible material and include pockets on two corners of the first flap, two corners of the second flap, and two corners of the third flap.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
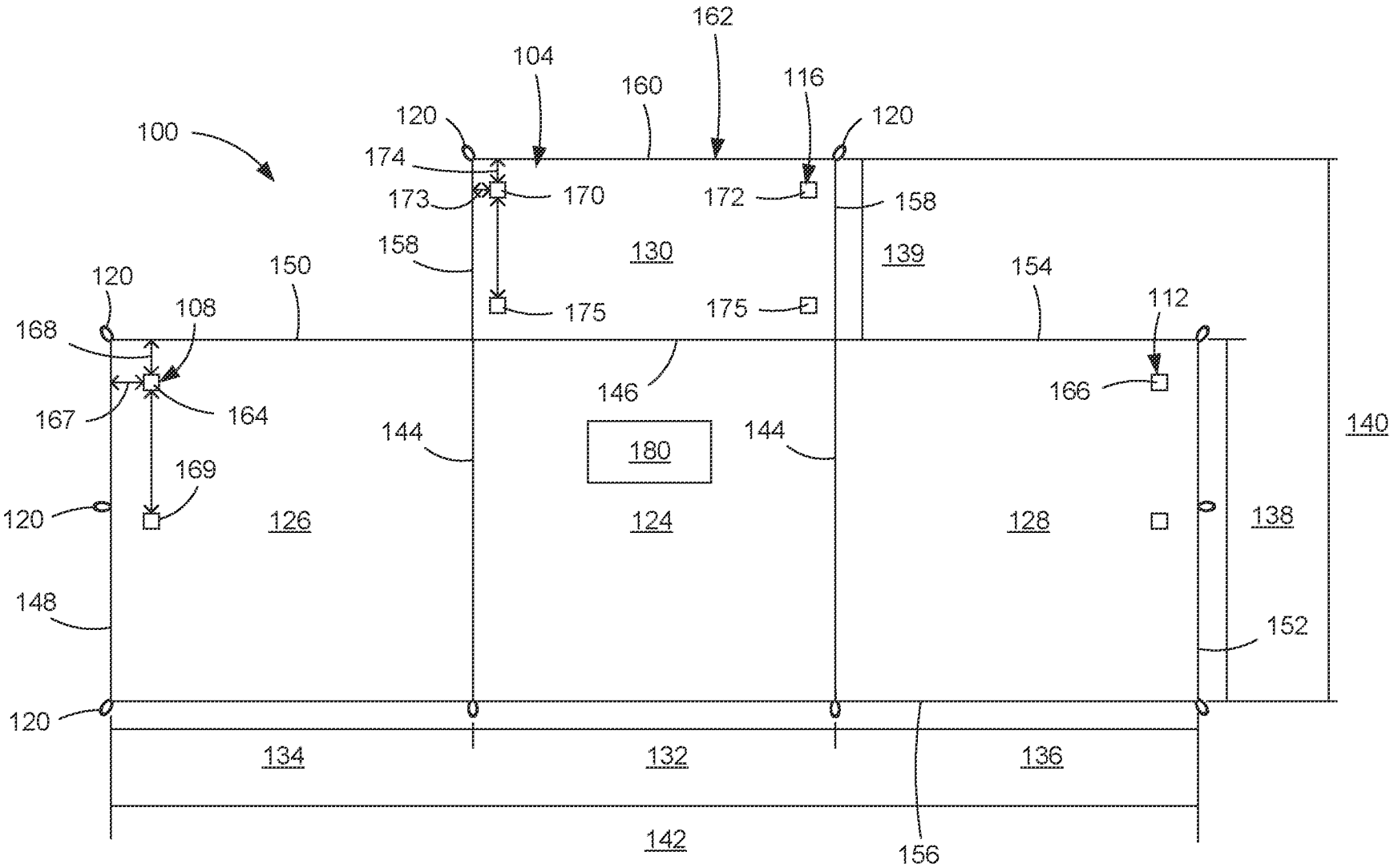
FIG. 1A depicts front plan view of a vehicle privacy curtain, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1B:
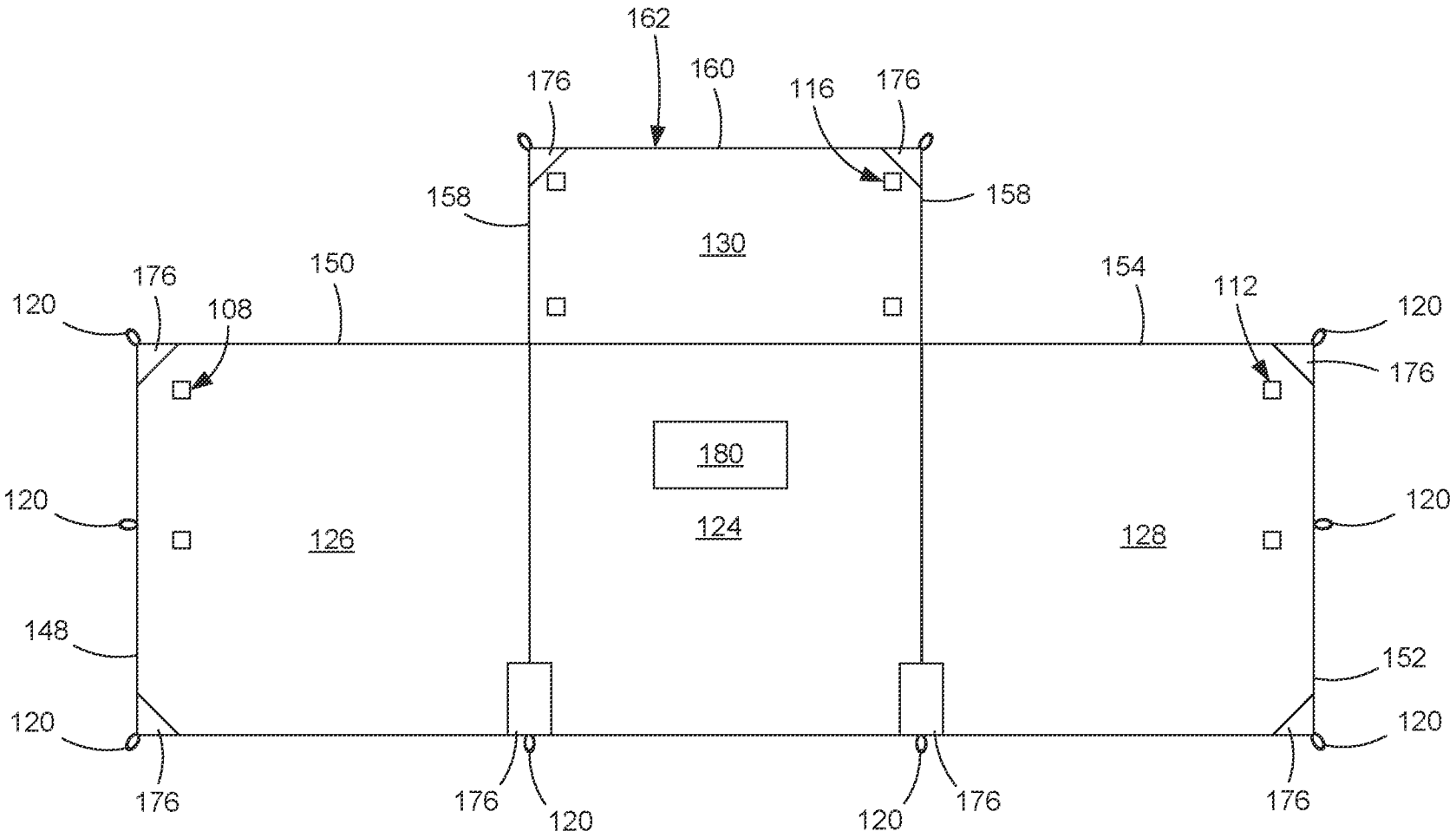
FIG. 1B depicts a rear plan view of a vehicle privacy curtain, according to one or more embodiments of the disclosure.

FIGS. 1A-1B depict a front and rear views of a vehicle privacy curtain 100, according to one or more embodiments. In various embodiments the privacy curtain 100 includes a piece of flexible material 104 and one or more sets of vehicle attachment devices. In one or more embodiments, the vehicle attachment devices are configured to removably attach to an exterior surface of a vehicle, such as a car, van, mini-van, or the like. For example, in various embodiments the vehicle attachment devices can include magnets, suction cups, adhesive connectors or another suitable device. In various embodiments, the vehicle attachment devices are intended to be connected to a specific part of a vehicle, for example an open rear hatch or the sides of a vehicle, such that when the attachment devices are connected to the vehicle the privacy curtain 100 forms enclosed area or semi-enclosed area in combination with vehicle. In such embodiments the curtain 100 is configured to obstruct the view into the enclosed area thereby providing a user improved privacy when inside. In such embodiments, the privacy curtain 100 allows a user to establish the enclosed area for example to allow the user to change clothes, or perform other tasks, while being visually obstructed from an outside observer. Thus, various embodiments provide a user with an improved level of privacy that would ordinarily be difficult to obtain with just their vehicle alone.

Depicted herein, and described further below, the vehicle privacy curtain 100 has vehicle attachment devices including a first set of magnets 108, a second set of magnets 112, and a third set of magnets 116. In various embodiments, each set of magnets is attached to the piece of flexible material 104 and is configured to magnetically attach to an exterior metal surface of a vehicle to secure the privacy curtain 100 to the vehicle. In certain embodiments, the vehicle privacy curtain 100 includes a plurality of attachment loops 120. In such embodiments the attachment loops 120 are fabric loops that are connected to the edge of the flexible material 104 at various points. The attachment loops 120 in certain embodiments can be connected to one or more other vehicle attachment devices to assist in securing the privacy curtain 100 to a vehicle. For example, in certain embodiments the attachment loops 120 could be connected to a suction cup device, or adhesive device, which in turn could be connected to a vehicle window or a non-magnetic surface of a vehicle to secure the privacy curtain 100 to the vehicle in lieu of or in addition to the various sets of magnets.

In one or more embodiments, the flexible material 104 includes a main portion 124, first flap 126, a second flap 128, and a third flap 130. In various embodiments the main portion 124 is positioned between the flaps with the first flap 126 and second flap 128 extending laterally from the main portion 124 and the third flap 130 extending vertically from the main portion 124. In various embodiments, the main portion 124 has a lateral width 132, the first flap 126 has a lateral width 134, and the second width has a lateral width 136. In various embodiments the lateral widths of the main portion 124 and the flaps can be different or the same. Depicted in FIGS. 1-2, the lateral widths are the approximately the same. As used herein, for purposes of this application, the term "approximately" or "approximate" indicates a range±10% of the given value to accommodate for manufacturing tolerances.

Similarly, in various embodiments the main portion 124, first flap 126, and second flap 128 have a vertical height 138. In various embodiments the vertical height 138 of the main portion 124 and the flaps can be different or the same. Depicted in FIGS. 1-2, the vertical height 138 is approximately the same plus or minus standard manufacturing tolerances. In one or more embodiments the third flap 130 has a vertical height 139. In various embodiments the vertical height 138 of the main portion 124 together with the vertical height 139 of the third flap 130 define a total vertical height 140 for the curtain 100. In one or more embodiments the lateral widths 132, 134, 136 together define a total lateral width 142 of the curtain 100.

In certain embodiments, the lateral widths 132, 134, 136 could be approximately fifty-seven inches and define a total lateral width of approximately one hundred and seventy-one inches. In certain embodiments, the vertical height 138 of the main portion 124 is approximately eighty inches and the vertical height 139 of the third flap 130 is approximately twenty-three inches. In such embodiments, the total vertical height 140 is approximately one hundred and three inches.

In some embodiments the main portion 124 includes a pair of vertically extending edges 144 and/or a laterally extending edge 146. In such embodiments the flexible material 104 can be constructed from multiple pieces with the flaps stitched or otherwise connected to the main portion 124 at the lateral edge 146 and/or the vertical edges 144. In some embodiments the main portion 124 and one or more of the flaps could be constructed from a single piece of material. In some embodiments the flexible material 104 is a three-panel unit. For example, in certain embodiments the main portion 124 and the third flap 130 is one panel with the first flap 126 and second flap 128 being connected to the vertical edges 144 of the main portion 124.

In various embodiments the first flap 126 defines a vertically extending first edge 148 and a laterally extending first top edge 150. In one or more embodiments the second flap 128 defines a vertically extending second edge 152 and a laterally extending second top edge 154. In various embodiments the first flap 126, the second flap 128, and the main portion 124 together form a bottom edge 156 that extends the total lateral width 142.

In one or more embodiments, the third flap 130 defines a pair of vertically extending edges 158 and a third laterally extending top edge 160 that extends partially along the total lateral width 142. In various embodiments, the pair of vertically extending edges 158 intersect with the first and second top edge 150, 154 such that the third top edge 160 is the top-most edge of the piece of flexible material 104. Further, in such embodiments the first and second top edge 150, 154, the pair of vertically extending edges 158, and the third top edge 160 together form a combined top edge 162 of the piece of flexible material 104.

The flexible material 104 can be constructed from any type of suitable fabric material including natural fabrics, synthetics, blends, and the like. For example, in certain embodiments the flexible material 104 could be constructed Nylon, cotton, wool, or a blend of materials. In various embodiments, the flexible material 104 could include one or multiple layers of materials that are sewn together. For example, in various embodiments the flexible material includes multiple layers so as to reduce visibility through the curtain 100 in the presence of bright sunlight or other light and improve the privacy characteristics of the curtain 100.

In one or more embodiments the sets of magnets are sewn into the flexible material 104 to permanently position the magnets in an optimal position to attach the curtain to the rear of a vehicle and form a privacy enclosure. For example, in various embodiments the first set of magnets 108 includes at least a first magnet 164 positioned inwardly from the first edge 148 at a distance of 0% to 33% of the lateral width 134 of the first flap 126. Similarly, in various embodiments the second set of magnets 112 includes at least a second magnet 166 positioned inwardly from the second edge 152 at a distance of 0% to 33% of the lateral width 136 of the second flap 128. More specifically, in certain embodiments the first set of magnets 108 includes two magnets including the first magnet 164 that is positioned inwardly from the first edge 148 a distance 167 of approximately seven inches and inwardly from the first top edge a distance 168 of approximately seven inches. An additional magnet 169 can be positioned approximately two feet lower than the first magnet 164. In various embodiments the second set of magnets 112 similarly includes the second magnet and another magnet that are positioned inwardly from the second edge in the same manner as the first set of magnets 108.

In one or more embodiments, the third set of magnets 116 includes at least a third magnet 170 positioned inwardly from one of the pair of vertically extending edges 158 and a fourth magnet 172 positioned inwardly from the other of the pair of vertically extending edges 158. In various embodiments the third and fourth are magnets positioned inwardly from their respective edges at a distance of 0% to 33% of a lateral width of the third flap 130. More specifically, in certain embodiments the third set of magnets 116 includes two magnets including the third magnet 170 that is positioned inwardly from one of the vertically extending edges 158 and the fourth magnet 172 positioned inwardly from the other of the vertically extending edges 158 each by a distance 173 of approximately five inches and inwardly from the third top edge a distance 174 of approximately five inches. In various embodiments additional magnets 175 are positioned approximately one foot lower.

As described above, in various embodiments, the vehicle privacy curtain includes a plurality of attachment loops 120. In such embodiments the attachment loops 120 are fabric loops that are connected to the edge of the flexible material at various points. The attachment loops 120 in certain embodiments can be connected to one or more other vehicle attachment devices to assist in securing the privacy curtain 100 to a vehicle. For example, in certain embodiments the attachment loops 120 could be connected to a suction cup device, or adhesive device, which in turn could be connected to a vehicle window or a non-magnetic surface of a vehicle to secure the privacy curtain 100 to the vehicle in lieu of or in addition to the various sets of magnets. Further, in various embodiments the attachment loops 120 can be utilized for other functions. For example, in certain embodiments the privacy curtain 100 can function as a beach blanket, tarp, or the like. In such embodiments the stakes could be driven through the attachment loops 120 to secure the flexible material 104 to the ground. Similarly, in various embodiments other add-on attachments like beach poles could be provided to allowing it to be used as a sunshade, or as cover from the elements, a tablecloth, a room or space for camping or tailgating, or the like. In certain embodiments, the curtain could be connected between two vehicles to form a barrier or enclosure between the two vehicles.

In one or more embodiments one or more pockets 176 are sewn into the rear side of the flexible material 104. For example, pockets 176 could be placed at corners of the flexible material 104 or other positions along the edge of the material. In various embodiments, the pockets 176 could be weighted, for example by filling them with sand or other material, to keep the curtain 100 from being blown away or otherwise moved from its position by the wind. In various embodiments the curtain 100 includes a pocket 176 at each corner of the flaps. In certain embodiments additional pockets 176 are included along the bottom edge 156. For example, depicted in FIG. 1B, the pockets 176 are positioned at the seam between the main portion 124 and the first and second flap 128. In such embodiments the curtain 100 includes a total of eight pockets spaced about the edges of the curtain 100.

In one or more embodiments the curtain 100 includes a window portion 180 in the flexible material 104. In such embodiments the window portion 180 can be positioned any part of the flexible material 104. Depicted in FIGS. 1A-1B the window portion 180 is positioned in the main portion 180 such that when a user is in the enclosed area the user can use the window portion 180 to view outside of the enclosed area. In certain embodiments the window 180 could be a one-way view such that a user in the enclosed area could see outside of the are while still maintaining the privacy of the curtain. In some embodiments a flap of material could be included in the window 180 to allow a user to selectively open and close the window when desired. In various embodiments, mesh or other material could be included in the window portion. Additional description of mesh material that could be used is found in U.S. Pat. No. 10,765,108, which is incorporated by reference herein.

Figure 2A:
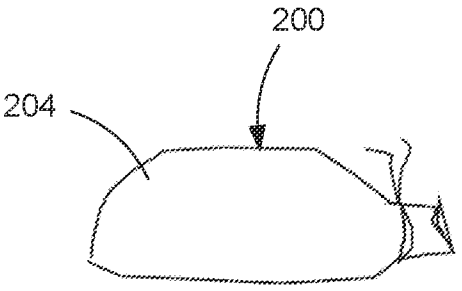
FIGS. 2A-2B depicts a kit including a vehicle privacy curtain in a packed configuration and am unpacked configuration, according to one or more embodiments of the disclosure.
Figure 2B:
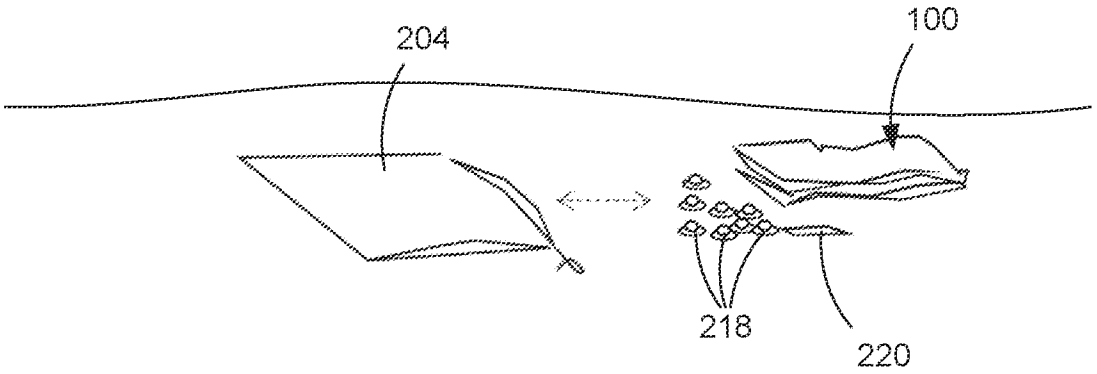

FIGS. 2A-2B depict a kit 200 including a vehicle privacy curtain 100 and associated accessories in a packed configuration and am unpacked configuration, according to one or more embodiments of the disclosure. In various embodiments, the curtain 100 can folded and packed or stored in a container 204, such a flexible bag or like. In such embodiments, after use the curtain 100 can be easily and quickly stored away and placed in a user's vehicle, purse, or other location for retrieval later. Similarly, in various embodiments, the curtain 100 is easily removed or unpacked from the container 204 for to establish a privacy curtain or for other use as described. In one or more embodiments the kit 200 includes one or more additional accessories which can include additional vehicle attachment devices. For example, depicted in FIG. 2B the kit 200 includes a plurality of suction devices 218 for use with the attachment loops as described herein. Further in one or more embodiments the kit 200 includes usage instructions 200. In one or more embodiments the usage instructions are a physical medium which includes instructions or a link to instructions that describe the method of usage of the privacy curtain and/or any accessories.

Figure 3A:
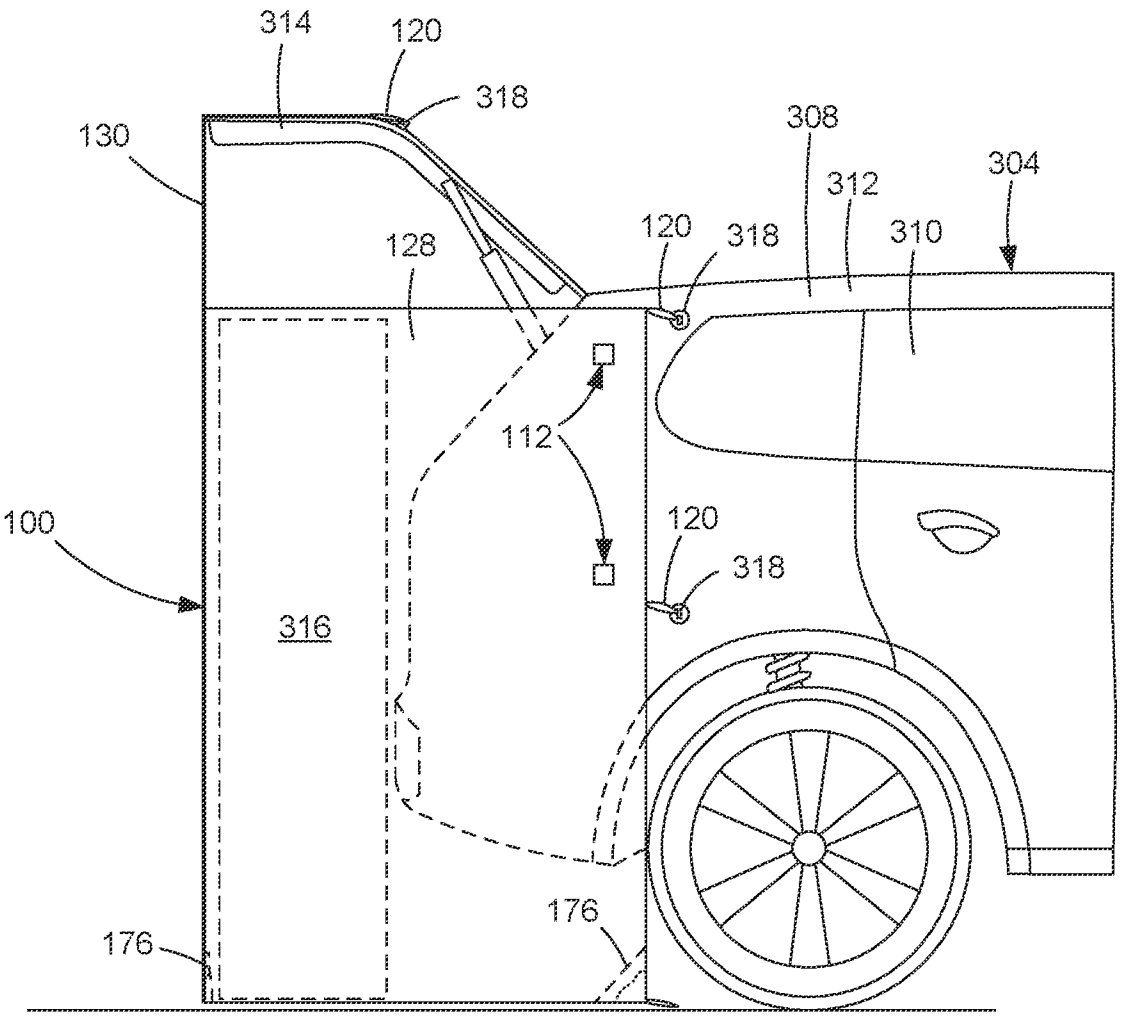
FIGS. 3A-3B depicts side views of a vehicle privacy certain when attached to a rear of a vehicle, according to one or more embodiments of the disclosure.
Figure 3B:
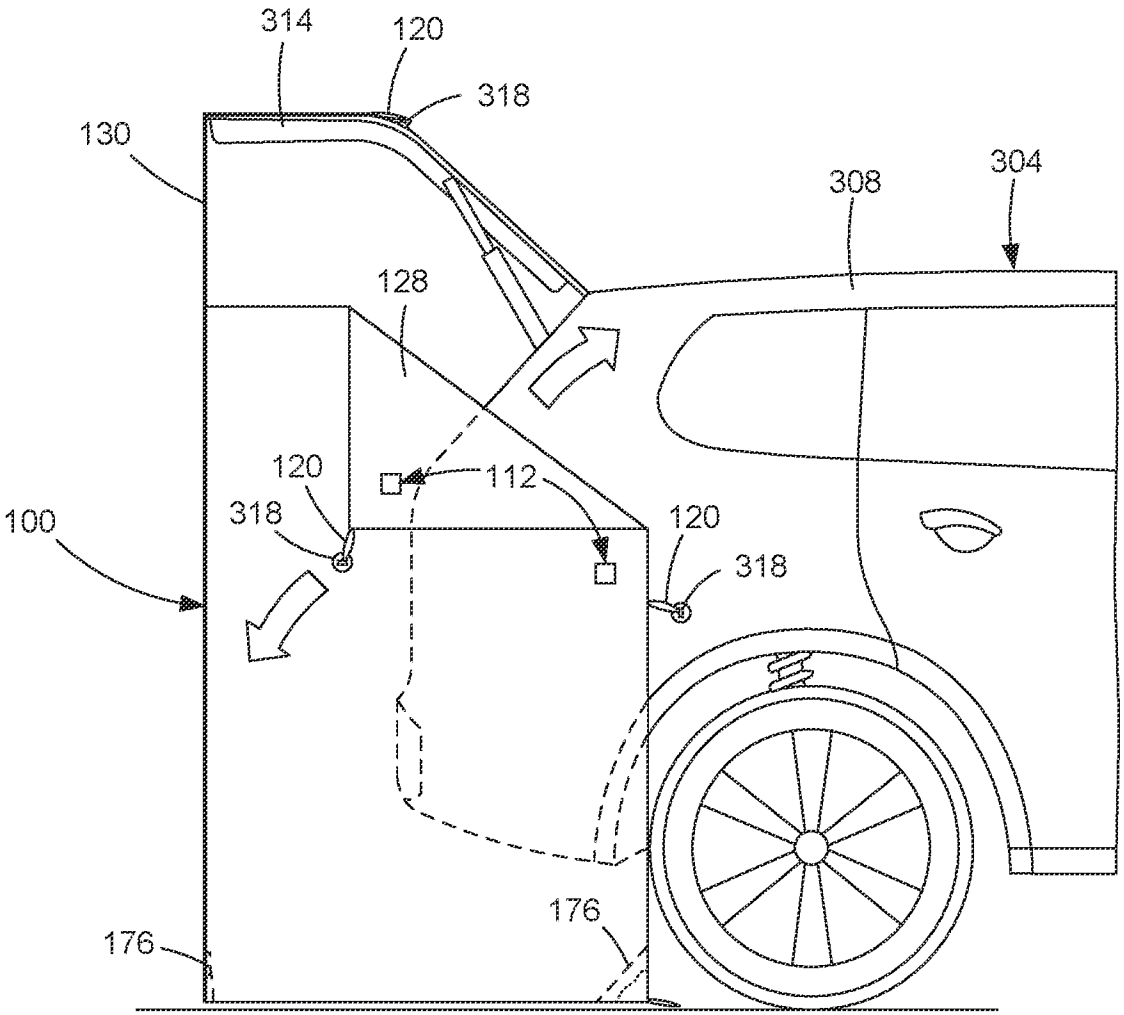
Figure 4:
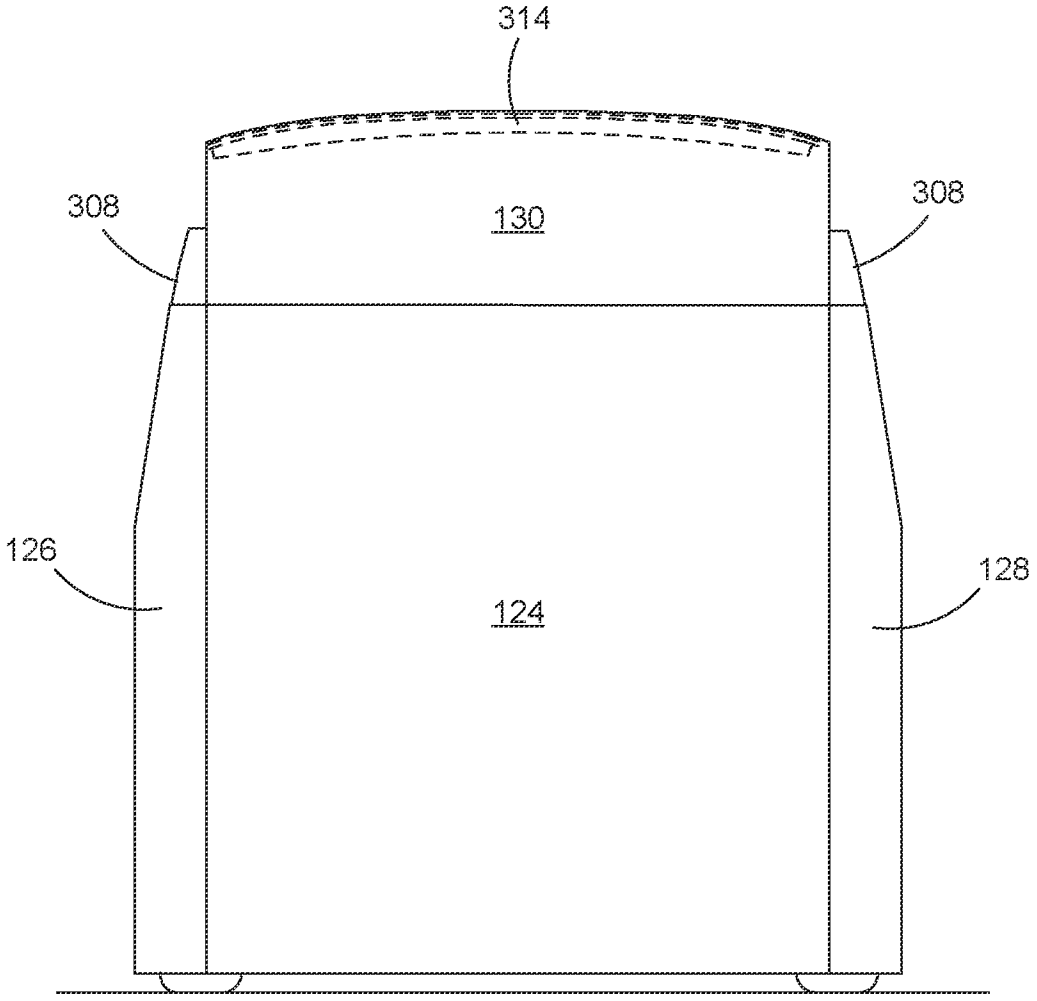
FIG. 4 depicts a rear view of a vehicle privacy certain when attached to a rear of a vehicle, according to one or more embodiments of the disclosure.

FIGS. 3A-3B, and FIG. 4 depict views of the vehicle privacy certain 100 when attached to a rear of a vehicle 304. Specifically, FIGS. 3A-3B depict stages of attachment to the rear of vehicle 304, while FIG. 4 depicts a rear view of the vehicle and attached curtain 100. Generally depicted, the vehicle 304 defines a rear end and includes a pair of sidewalk 308 including a window 310 and a metallic exterior 312.

The vehicle 304 includes a hatchback door 314 that is configurable between an open position and a closed position. Depicted herein, and as described above, the curtain 100 includes one or more the vehicle attachment devices that are intended to be connected to a specific part of a vehicle, for example the hatchback door 314 and the sidewalls 308, such that the privacy curtain 100 forms enclosed area 316 or semi-enclosed area in combination with vehicle 304. In such embodiments the curtain 100 is configured to obstruct the view into the enclosed area thereby providing a user improved privacy when inside. In such embodiments, the privacy curtain 100 allows a user to establish the enclosed area for example to allow the user to change clothes, or perform other tasks, while being visually obstructed from an outside observer.

In various embodiments, to form the enclosure the first and second flaps, are attached to the sidewalls 308 of the vehicle 100 using the corresponding first and second sets of magnets to a respective side of the vehicle 100. For example, depicted in FIG. 3A, the second flap 128 is attached to sidewall 308 via the second set of magnets 112. In one or more embodiments the attachment loop 120 is connected to a suction cup device, or adhesive device, which is attached to the vehicle window 310 or a non-magnetic surface of a vehicle in lieu of or in addition the magnets. For example, depicted in FIG. 3A, a pair of suction cup devices 318 are attached to the attachment loops 120 and to the vehicle 100 to further attach the curtain 100. Similarly, in one or more embodiments the third flap 130 is attached to the exterior of the hatchback door 314 using the third set of magnets 116. In such embodiments the rest of the fabric can drape down to the ground creating the enclosed area 316 behind the vehicle 304 when the hatchback door 314 is open. Depicted in FIG. 3A, in various embodiments, pockets 176 can be filled or weighted to further assist in forming the enclosed area 316. For example, in one or more embodiments sand could be placed into the pockets 176 to keep the bottom of the curtain from blowing around in the wind. Depicted in FIG. 3B, when a user is finished with the curtain 100, the user can remove the curtain by simply pulling the unit off their vehicle 304. Once finished, the user can fold the curtain and return it to a carrying bag.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A vehicle privacy curtain comprising:

a piece of flexible material having a front side and a rear side and having a lateral width and a vertical height, the piece of flexible material including:

a main portion positioned between a laterally extending first flap, a laterally extending second flap, and a vertically extending third flap;

wherein the first flap defines a vertically extending first edge and a laterally extending first top edge, the second flap defines a vertically extending second edge and a laterally extending second top edge, wherein the first flap, the second flap, and the main portion together form a bottom edge that defines the lateral width of the piece of flexible material;

wherein the third flap defines a pair of vertically extending edges and a third laterally extending top edge that extends partially along the lateral width of the piece of flexible material, wherein the pair of vertically extending edges intersect with the first and second top edge and the third top edge is a top-most edge of the piece of flexible material, wherein the first and second top edge, the pair of vertically extending edges, and the third top edge together form a top edge of the piece of flexible material;

wherein the third flap and the main portion together define the vertical height of the piece of flexible material;

a first set of magnets in the first flap, the first set of magnets including at least a first magnet positioned inwardly from the first edge at a distance of 0% to 33% of a lateral width of the first flap;

a second set of magnets in the second flap, the second set of magnets including at least a second magnet positioned inwardly from the second edge at a distance of 0% to 33% of a lateral width of the second flap;

a third set of magnets in the third flap, the third set of magnets including at least a third magnet positioned inwardly from one of the pair of vertically extending edges and a fourth magnet positioned inwardly from the other of the pair of vertically extending edges, the third and fourth magnets positioned inwardly from their respective edges at a distance of 0% to 33% of a lateral width of the third flap;

a plurality of pockets configured to receive material to weight the privacy curtain, the plurality of pockets formed on the rear side of the flexible material and including a pockets on two corners of the first flap, two corners of the second flap, and two corners of the third flap.

2. The privacy curtain of claim 1, wherein the main portion includes a first vertically extending side and a second vertically extending side, and wherein the first flap is connected to the first vertically extending side and the second flap is connected to the second vertically extending side.

3. The privacy curtain of claim 2, wherein the flexible material is a three-panel unit with the third flap and the main portion being a single piece of material.

4. The privacy curtain of claim 2, wherein the plurality of pockets includes at the bottom edge of the flexible material, a pocket at the connection of the first flap and the main portion and a pocket at the connection of the second flap and the main portion.

5. The privacy curtain of claim 1, wherein the piece of flexible material is constructed from nylon.

6. The privacy curtain of claim 1, wherein the lateral width of the first flap and the lateral width of the second flap is approximately 57 inches.

7. The privacy curtain of claim 1, wherein the lateral width of the piece of flexible material is approximately 171 inches.

8. The privacy curtain of claim 1, wherein the vertical height of the piece of flexible material is approximately 103 inches.

9. The privacy curtain of claim 1, wherein the first set of magnets includes the first magnet positioned inwardly from the first edge at a distance of approximately 7 inches and the second set of magnets includes the second magnet positioned inwardly from the second edge at a distance of approximately 7 inches.

10. The privacy curtain of claim 1, wherein the third set of magnets includes the third magnet positioned inwardly from one of the pair of vertically extending edges and the fourth magnet positioned inwardly from the other of the pair of vertically extending edges, the third and fourth magnets positioned inwardly from their respective edges at a distance of approximately 5 inches.

11. The privacy curtain of claim 1, further comprising a vehicle having a hatchback door and a pair of sidewalls, wherein the first flap and the second flap are attached to one of the respective pair of sidewalls via the first and second set of magnets and wherein the third flap is connected to the hatchback door via the third set of magnets.

12. The privacy curtain of claim 11, wherein when the hatchback door is in an open configuration the privacy curtain forms an enclosed area between the flexible material and the vehicle.

13. The privacy curtain of claim 1, further comprising a plurality of attachment loops attached to edges of the piece of flexible material.

14. The privacy curtain of claim 13, wherein the plurality of attachment loops are configured to be connected to one or more vehicle attachment devices to assist in securing the privacy curtain to a vehicle.

15. The privacy curtain of claim 1, wherein the first, second, and third set of magnets are the only vehicle attachment devices included in the flexible material.

16. A privacy curtain kit comprising:

a flexible material container;

a vehicle privacy curtain comprising:

a piece of flexible material having a front side and a rear side and having a lateral width and a vertical height, the piece of flexible material including:

a main portion positioned between a laterally extending first flap, a laterally extending second flap, and a vertically extending third flap;

wherein the first flap defines a vertically extending first edge and a laterally extending first top edge, the second flap defines a vertically extending second edge and a laterally extending second top edge, wherein the first flap, the second flap, and the main portion together form a bottom edge that defines the lateral width of the piece of flexible material;

wherein the third flap defines a pair of vertically extending edges and a third laterally extending top edge that extends partially along the lateral width of the piece of flexible material, wherein the pair of vertically extending edges intersect with the first and second top edge and the third top edge is a top-most edge of the piece of flexible material, wherein the first and second top edge, the pair of vertically extending edges, and the third top edge together form a top edge of the piece of flexible material;

wherein the third flap and the main portion together define the vertical height of the piece of flexible material;

a first set of magnets in the first flap, the first set of magnets including at least a first magnet positioned inwardly from the first edge at a distance of 0% to 33% of a lateral width of the first flap;

a second set of magnets in the second flap, the second set of magnets including at least a second magnet positioned inwardly from the second edge at a distance of 0% to 33% of a lateral width of the second flap;

a third set of magnets in the third flap, the third set of magnets including at least a third magnet positioned inwardly from one of the pair of vertically extending edges and a fourth magnet positioned inwardly from the other of the pair of vertically extending edges, the third and fourth magnets positioned inwardly from their respective edges at a distance of 0% to 33% of a lateral width of the third flap;

a plurality of pockets configured to receive material to weight the privacy curtain, the plurality of pockets formed on the rear side of the flexible material and including a pockets on two corners of the first flap, two corners of the second flap, and two corners of the third flap;

one or more vehicle attachment devices configured for connection to the vehicle privacy curtain; and usage instructions comprising a physical medium having instructions or a link to instructions for use of the privacy curtain.

* * * * *